US009345352B2

(12) United States Patent
Shendelman

(10) Patent No.: US 9,345,352 B2
(45) Date of Patent: May 24, 2016

(54) PORTABLE FOOD HANDLING DEVICES

(71) Applicant: Leonid Shendelman, Brooklyn, NY (US)

(72) Inventor: Leonid Shendelman, Brooklyn, NY (US)

( * ) Notice: Subject to any disclaimer, the term of this patent is extended or adjusted under 35 U.S.C. 154(b) by 0 days.

(21) Appl. No.: 14/215,662

(22) Filed: Mar. 17, 2014

(65) Prior Publication Data

US 2014/0261095 A1 Sep. 18, 2014

Related U.S. Application Data

(60) Provisional application No. 61/790,285, filed on Mar. 15, 2013.

(51) Int. Cl.

| | |
|---|---|
| ***A47B 85/00*** | (2006.01) |
| ***A47G 21/00*** | (2006.01) |
| ***A47G 23/06*** | (2006.01) |

(52) U.S. Cl.

CPC ..... *A47G 21/001* (2013.01); *A47G 23/0625* (2013.01); *A47G 2023/0666* (2013.01)

(58) Field of Classification Search

CPC .. A47B 13/16; A47B 37/00; A47B 2031/003; A47B 2031/005; A47B 2031/008; A47F 5/0093; A47F 7/0071; A47G 19/32

USPC ..... 108/25, 26, 50.01, 50.02, 50.11, 50.18; 211/162, 85.4, 51; 206/216, 575, 206/495.03; 220/495.03; 221/223, 123, 221/132, 124

See application file for complete search history.

(56) References Cited

U.S. PATENT DOCUMENTS

| | | | | |
|---|---|---|---|---|
| 1,221,217 | A * | 4/1917 | Quinliven et al. | 221/119 |
| 1,734,045 | A * | 11/1929 | Parran | 221/150 HC |
| 2,020,514 | A * | 11/1935 | Moffitt | 211/51 |
| 2,049,114 | A * | 7/1936 | Gallamore | 108/25 |
| 2,210,972 | A * | 8/1940 | Christenson | 108/25 |
| 4,708,256 | A * | 11/1987 | Intardonato | 220/23.4 |
| 4,907,707 | A * | 3/1990 | Crum | 211/59.3 |
| 5,322,023 | A * | 6/1994 | Hammond | 108/50.12 |
| 5,493,976 | A * | 2/1996 | Hammond | 108/50.12 |
| 6,971,613 | B2 * | 12/2005 | Shendelman | 248/150 |
| 7,207,450 | B1 * | 4/2007 | Franklin et al. | 108/25 |
| 2008/0017226 | A1 * | 1/2008 | Nobert et al. | 108/50.12 |
| 2008/0169408 | A1 * | 7/2008 | Berman et al. | 108/25 |
| 2013/0284619 | A1 * | 10/2013 | Daley | 206/216 |

* cited by examiner

*Primary Examiner* — Jose V Chen
(74) *Attorney, Agent, or Firm* — Kirschstein, et al.

(57) ABSTRACT

A food handling device for use in eating a foodstuff, includes a holder and a movable member supported by the holder for movement along a longitudinal direction relative to the holder by a user. The movable member engages the foodstuff. Multiple food handling devices may be mounted on a serving platter of a food service assembly.

20 Claims, 8 Drawing Sheets

FIG. 10
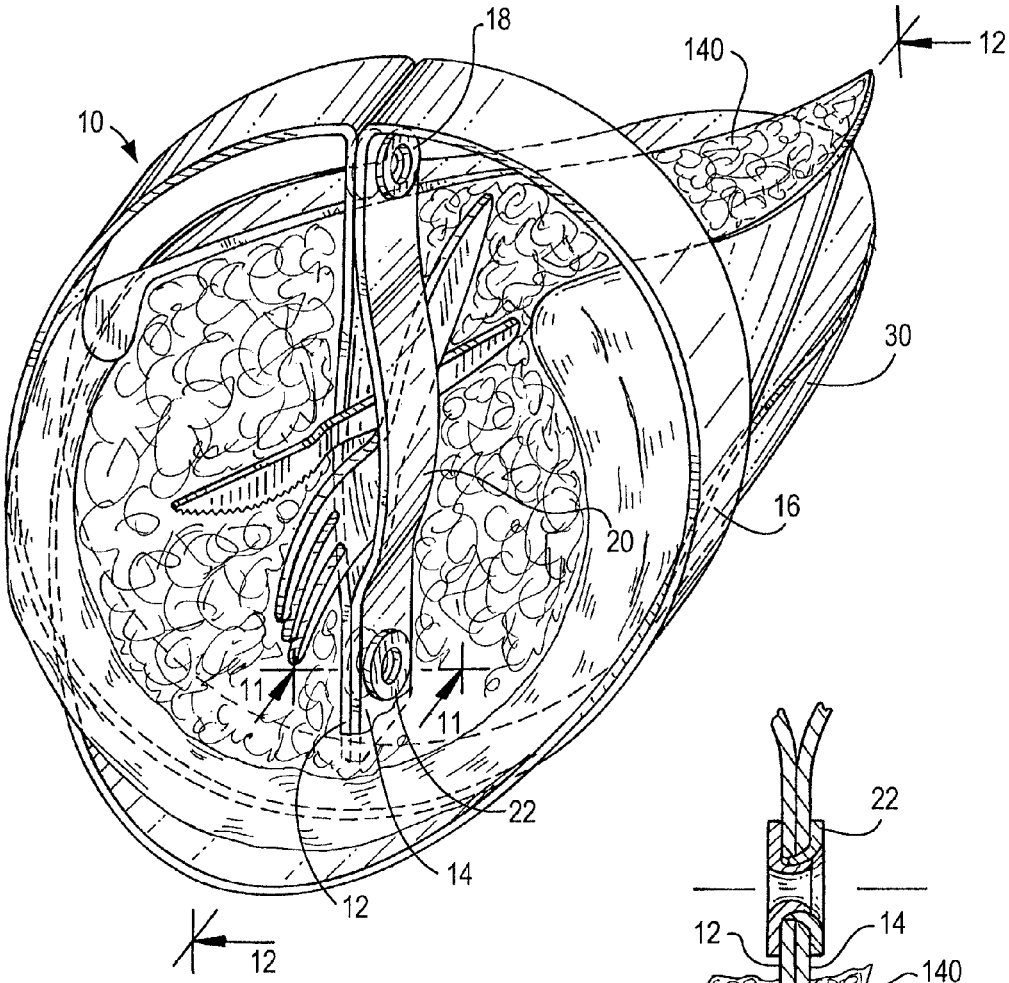
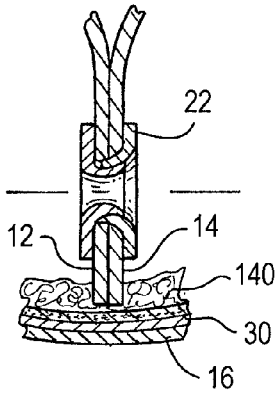
FIG. 11

PORTABLE FOOD HANDLING DEVICES

CROSS REFERENCE TO RELATED APPLICATION

This application claims priority to U.S. Provisional Patent Application Ser. No. 61/790,285, filed Mar. 15, 2013, the entire content of which is hereby expressly incorporated herein by reference thereto.

BACKGROUND

The present disclosure generally relates to portable food handling devices for use during eating foodstuffs, especially those often considered as difficult, awkward, or messy to handle, such as slices of pizza, and, more particularly, for holding and eating such foodstuffs in a sanitary, tidy manner, that is without soiling one's hands, without spilling drippings, pieces, or toppings of the foodstuff, and without requiring the use of any traditional eating utensils, such as knives and forks.

Pizza is an example of a foodstuff that is often difficult to handle, especially when the foodstuff is hot. The commonest form in which pizza is served is a generally triangular sector slice taken from a circular pie, generally formed when the pie is cut by several diametrical slices. This form is difficult to handle mostly because of the soft and limp nature of the pointed end, which tends to droop and allow any loose toppings, usually lubricated by cheese and sauce, to slide off and often end up on the user's hands, food tray, or lap. Other types of messy foods include, for example, a hot dog, especially when smothered with multiple loose toppings, a hamburger, a gyro, a taco, a burrito, etc. Frequently, toppings, including sauce, can fall off from the foodstuff, even when held with two hands.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the instant disclosure, and explain various principles and advantages of those embodiments.

FIG. 10 is a front perspective view of another embodiment of a food handling device in accordance with this disclosure.

FIG. 11 is a sectional view taken on line 11-11 of FIG. 10.

Figure 1:
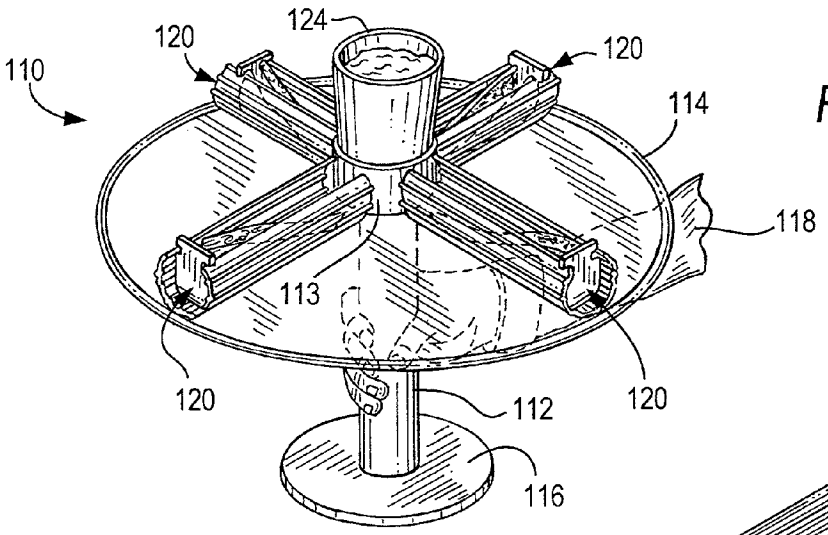
FIG. 1 is a perspective view of a portable food service assembly containing a plurality of food handling devices in accordance with this disclosure.
Figure 2:
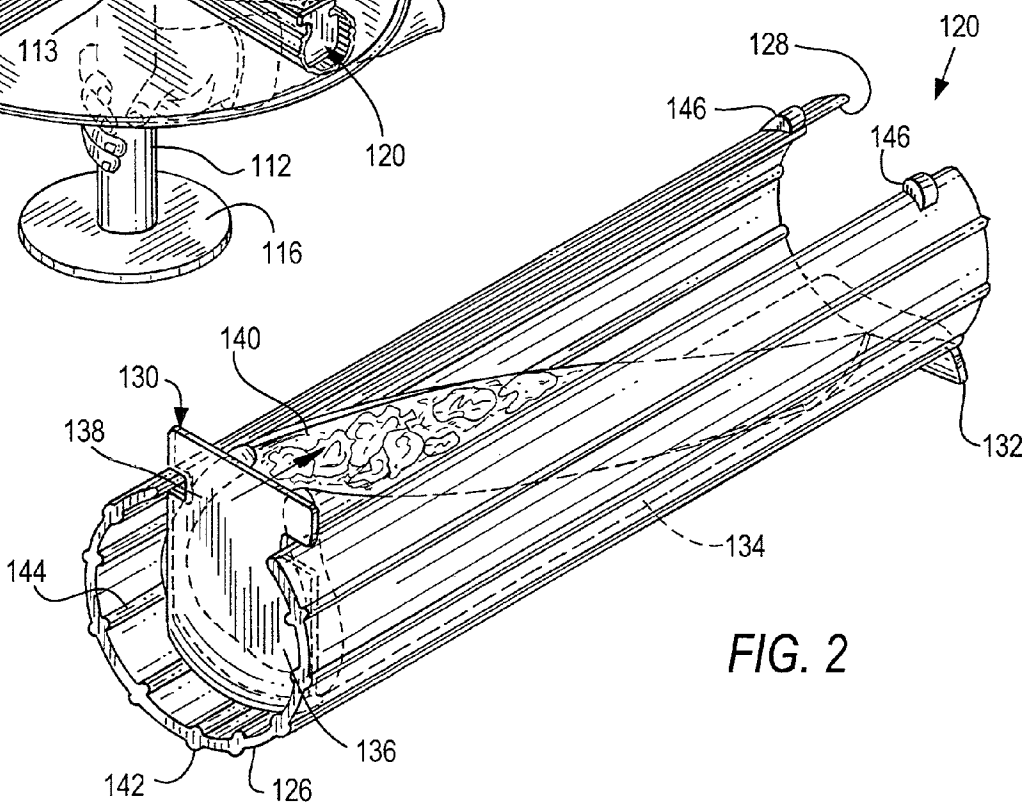
FIG. 2 is an enlarged perspective view of one of the food handling devices of the assembly of FIG. 1.
Figure 3:
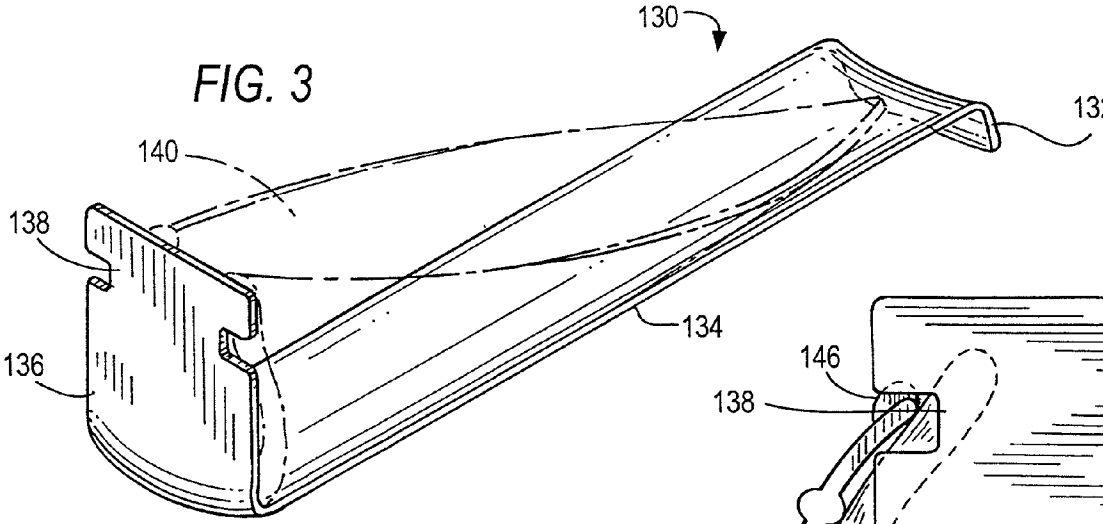
FIG. 3 is an enlarged perspective view of a detail of the device of FIG. 2.
Figure 4:
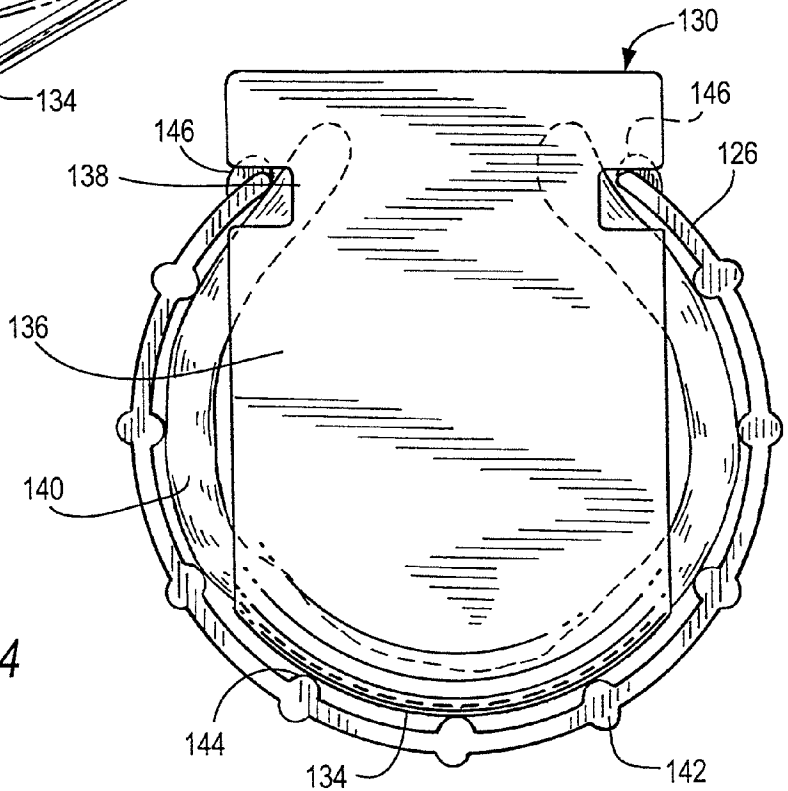
FIG. 4 is an enlarged end view of the device of FIG. 2.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present disclosure.

The device and assembly components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 16:
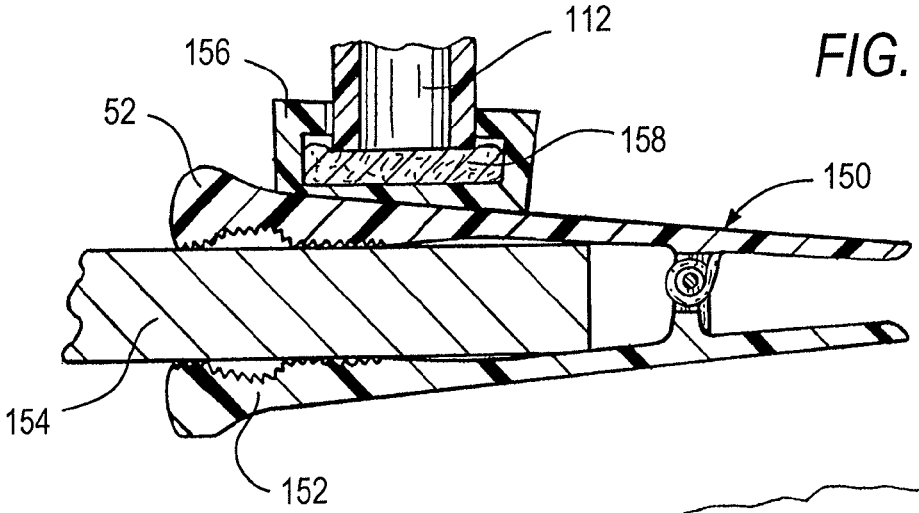
FIG. 16 is a broken-away, enlarged, sectional view of a variant mounting of the food service assembly of FIG. 1.
Figure 17:
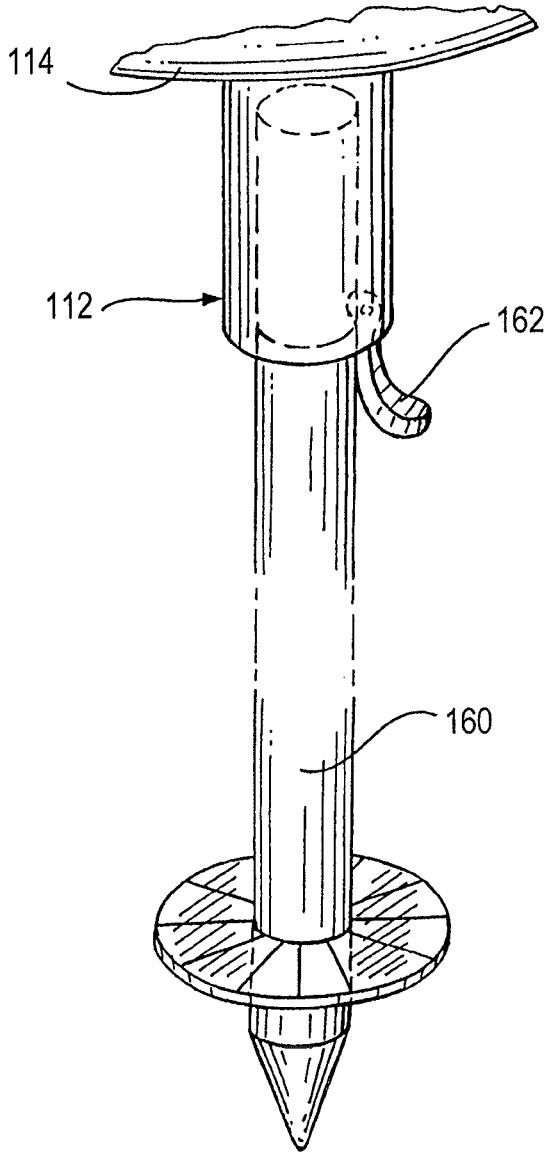
FIG. 17 is a broken-away, side view of another variant mounting of the food service assembly of FIG. 1.
Figure 18:
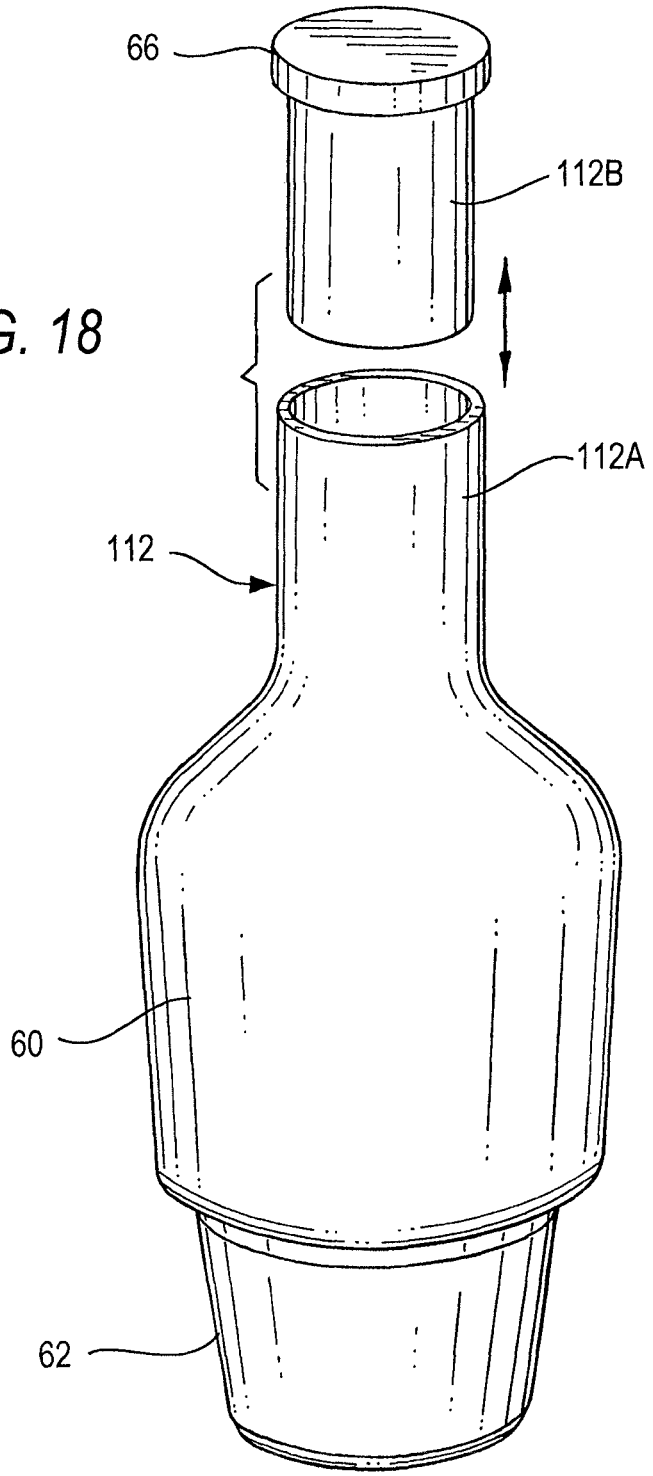
FIG. 18 is a broken-away, side view of another variant mounting of the food service assembly of FIG. 1.

Turning now to FIGS. 1-4, a portable service assembly 110 includes a plate or serving platter 114, a support 112 held by a user 118, and a base 116. The support 112 need not be a cylindrical column as illustrated in FIG. 1, but could have other shapes, e.g., a stepped column, a frustoconical column, or a part-cylindrical and part-frustoconical column. The column could be solid or hollow, and has a diameter sized to be readily gripped in the palm of a user's hand so that the assembly 110 may easily be carried by one hand from place to place. The hollow interior of the column could be used to store any item, such as napkins, straws, electronic devices, utensils, writing implements, condiment packages, etc. The base 116 in FIG. 1 has a planar bottom surface for stable mounting on a support surface, such as the floor or a table. If the support surface is made of a magnetically attractable material, then, in one advantageous embodiment, the bottom surface of the base 116 may be constituted of a magnetic material for magnetic attraction to, and holding by, the magnetically attractable support surface. The base 116 could therefore be of one-piece with the column, or could be a separate detachable part that can be readily attached to the column. For example, the base 116 can be threadedly or magnetically attached to the column, or can be attached by a snap-type action. FIGS. 16-18, as described below, illustrate other mounting arrangements relative to support surfaces.

A drink container or liquid substance-containing cup 124 may be mounted, and held with a friction fit, in a central hollow cylindrical portion 113 of the assembly 110, preferably inside an opening in the platter 114. The container 124 may be removed and replaced at will. The container 124 need not be frustoconical in shape as illustrated, but could have other shapes, e.g., cylindrical. The container 124 may contain water, or cold beverages, such as soda, a milk shake, alcoholic beverages, etc., or hot beverages, such as coffee, tea, hot chocolate, soup, etc., or any semi-liquid substance, such as yogurt, hummus, mustard, ketchup, etc. Use of the container 124 is optional.

A plurality of food handling devices 120 are radially arranged on the platter 114. The food holding devices 120 need not be radially arranged as shown, but could be arranged in different numbers and layouts. A representative food handling device 120 is shown individually in FIG. 2. The food handling device 120 includes a portable, elongated, tubular holder 126 bounding an interior in which a foodstuff, e.g., a slice of pizza, a pastry, a cake, a gyro, a doughnut, a taco, a hot dog, a hamburger, a burrito, a pirogi, a sandwich, etc., is placed. The holder 126 has a longitudinal channel or slot 128. The holder 126 can have various shapes, for example, a cylindrical shape, or a conical shape suitable for compact storage, transport, and handling. A movable member 130, shown individually in the embodiment of FIG. 3, has an elongated support portion or body 134, a handle portion 132 at one end of the body 134, an upright arm portion 136 at an opposite end of the body 134, and a neck portion 138. The movable member 130 is initially positioned inside the holder 126 such that the handle portion 132 is located outside an open axial end of the holder 126, and the neck portion 138 is positioned in the longitudinal slot 128.

Using a slice of pizza 140 (see FIG. 4) as an example of a foodstuff that can advantageously be placed inside the holder 126, the pizza slice 140 is placed on top of the movable member 130 such that its rear crust at its broader end is adjacent the upright arm portion 136. In use, the user 118 takes one of the food handling devices 120 off the platter 14 with one hand, and brings the device 120 near the user's mouth. Then, the user 118 grips and manipulates the handle portion 132 with the user's other hand, and progressively pulls the movable member 130 towards the user 118 with the user's other hand, and incrementally slides the pizza slice 140 out of the holder 126, thereby enabling the user 118 to progressively advance the pointed front leading end of the pizza slice 140 in steps out of the holder 126 towards the user's mouth in order to eat the pizza slice 140 bite-by-bite in a sanitary manner, that is, without dropping any toppings from the pizza slice 140, without soiling one's hands, and without requiring the use of any traditional eating utensils. During the eating, the handle portion 132 is pulled down, thereby bending and folding the support portion 134 out of the way from the user's mouth. Advantageously, the movable member 130 is made of a bendable, flexible material. As noted above, pizza is an unusually difficult food to handle in anon-awkward manner. Prior to use of the food handling device 120, the pizza slice 140 and all its toppings are fully contained within the device 120. During eating, only the leading end of the pizza slice 140 is exposed for eating.

The holder 126 may have sensors 146 to indicate, and to record, the quantity of the foodstuff that has been moved a distance through the holder 126 and has been eaten. This recorded information can be stored, together with the caloric value of the particular foodstuff, and can be sent to remote monitoring facilities that calculate the user's daily calorie consumption data, to thereby monitor the health, and assist in controlling the weight of, the user. The holder 126, together with a foodstuff therein, may be placed in a refrigerator, and subsequently in a thermos or lunch box, for further subsequent consumption in any venue, for example, schools, food stands, workplaces, stadiums, recreational outdoor activities, sporting events, etc. As shown, the outer and inner walls of the holder 126 may be formed with raised outer ribs 142 and/or raised inner ribs 144. The outer ribs 142 enable the user 118 to more securely hold the holder 126. The channels between the inner ribs 144 may collect drippings from the pizza slice 140 or other foodstuff. Both the outer ribs 142 and the inner ribs 144 also serve as thermal insulators to prevent any heat from the pizza slice 140 or other hot foodstuff from being transferred to the user's hand. The holder 126 may be constituted of any material, for example, a resilient material that permits the holder 136 to be squeezed, but when constituted of a corrugated board material, the ribs 142, 144 are advantageously formed of the flutes or corrugations of the board material. The holder 126 may alternatively be provided with smooth outer and inner walls. The holder 126, together with the foodstuff, may also be microwaveable.

Figure 5:
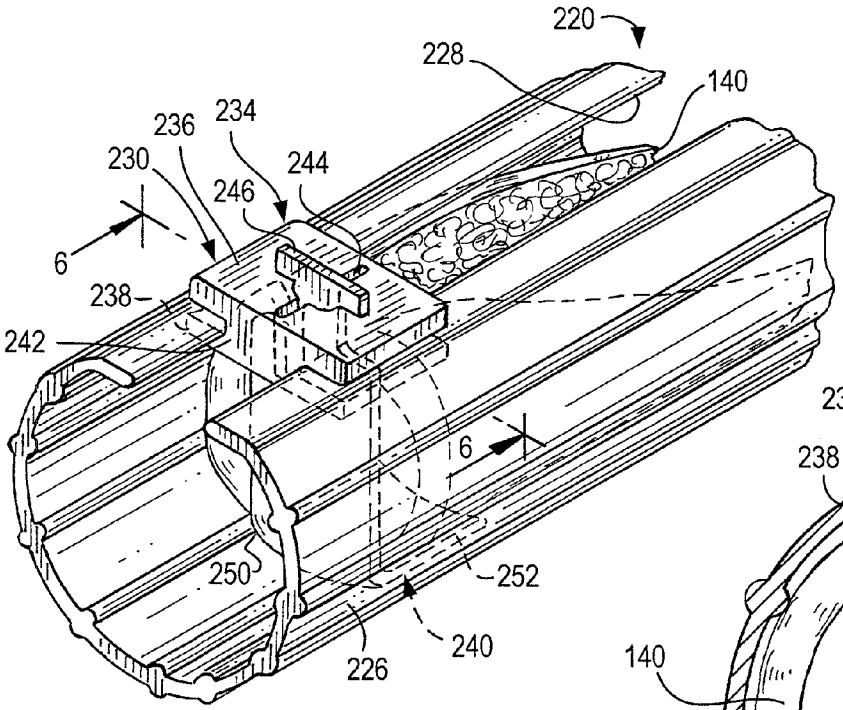
FIG. 5 is a broken-away, enlarged perspective view of another food handling device for the assembly of FIG. 1 in accordance with this disclosure.
Figure 6:
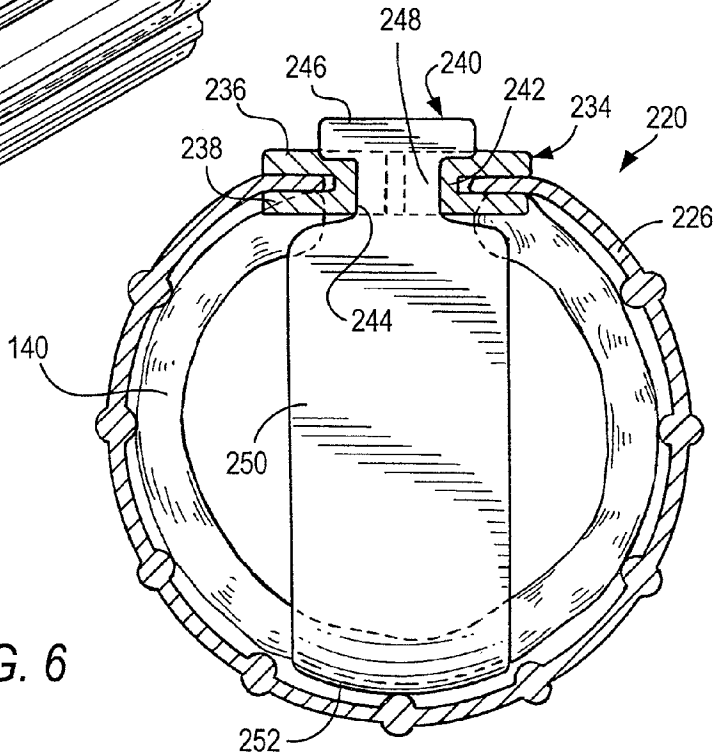
FIG. 6 is a sectional view taken on line 6-6 of FIG. 5.
Figure 7:
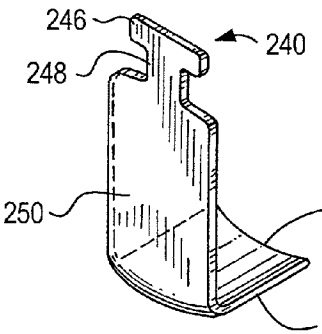
FIG. 7 is an enlarged, perspective view of a detail of the device of FIG. 5.

FIG. 5 depicts another embodiment of a food handling device 220 that is similar to the food handling device 120. The food handling device 220 includes a tubular holder 226 bounding an interior in which the foodstuff 140, as described above, is placed. The holder 226 has a longitudinal channel or slot 228. The holder 226 can have various shapes, for example, a cylindrical shape, or a conical shape suitable for compact storage, transport, and handling. A pulling assembly 230 includes a bracket 234 mounted on the holder 226 for sliding longitudinal movement lengthwise of the slot 228, and a movable member 240 shown individually in FIG. 7. As best seen in FIG. 6, the bracket 234 has an outer flange 236 located outside the holder 226, an inner flange 238 located inside the holder 226, a connecting portion 242 that interconnects the flanges 236, 238 and that is located in the slot 228, and a passage 244 that extends through the flanges 236, 238 and the connecting portion 242. The movable member 240 has a handle portion 246 at one end, a neck portion 248 that extends through the passage 244, an upright arm portion 250, and an elongated body or support portion 252 that preferably terminates in a concave edge 254. The handle portion 246 is positioned perpendicularly to the passage 244. Prior to use of the food handling device 220, the pizza slice 140 and all its toppings are fully contained within the device 220. During eating, only the leading end of the pizza slice 140 is exposed for eating.

Again using the pizza slice 140 as an example of a foodstuff that can advantageously be placed inside the holder 226, the pizza slice 140 is placed on top of the movable member 240 such that its rear crust at its broader end is adjacent the upright arm portion 250. In a variation, the pizza slice 140 need not be placed on top of the movable member 240, but instead, could be positioned axially adjacent the pizza slice 140. In use, the user 118 holds the device 220 with one hand near the user's mouth. Then, the user grips the handle portion 246 or the bracket portion 234 with the user's other hand, and progressively pulls the movable member 240 towards the user with the user's other hand, and incrementally slides the bracket 234 and the movable member 240 lengthwise of the slot 228 and the holder 226, thereby enabling the user to progressively advance the pointed front leading end of the pizza slice 140 in steps out of the holder 226 in order to eat the pizza slice 140 bite-by-bite in a sanitary manner, that is without spilling any toppings, without soiling one's hand, and without requiring the use of any traditional eating utensils. The movable member 240 can either carry the pizza slice, or push the pizza slice 140, during such movement.

Figure 8:
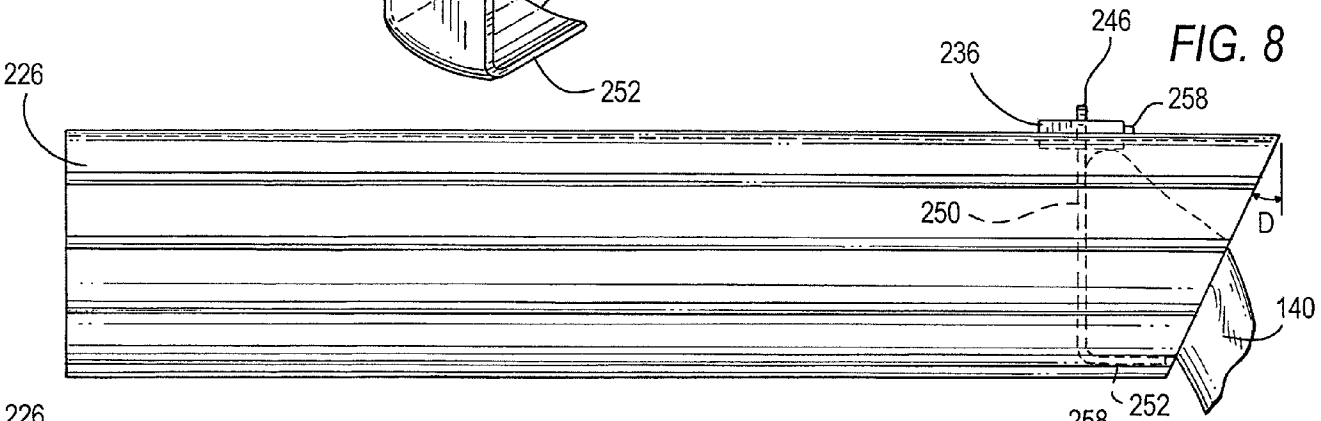
FIG. 8 is an enlarged, side view of the device of FIG. 5.

The concave edge 254 helps to insure that the user will not bite down hard on the movable member 240 during eating. Similarly, as shown in FIG. 8, the outer end of the holder 226, i.e., the end that is closest to the user's mouth during eating, is rearwardly tapered by an angle "D", to again prevent the user from biting down hard on the outer end of the holder 226. The concave edge 254 on the movable member 240 and the outer tapered end of the holder 226 could also be implemented on the movable member 130 and the holder 126 described above. A plurality of food handling devices 220 may be arranged on the platter 114 in analogous manner to that described above for food handling devices 120.

Figure 9:
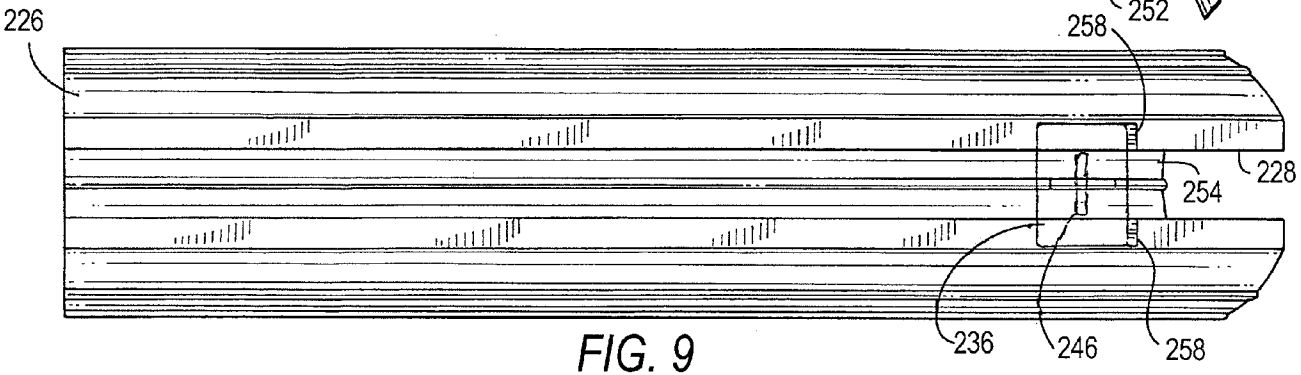
FIG. 9 is an enlarged top plan view of FIG. 8.

FIG. 9 also depicts a pair of stops 258 that abut against the upper flange 236 of the sliding bracket 234 and prevent the sliding bracket 234 from moving past the stops 258. Similar stops could be provided on the holder 126 described above to prevent the movable member 130 from moving off the holder 126. In addition, the holder 226 could be provided with the above-described sensors 146. The holder 226 is advantageously constituted of the same materials described above for holder 126.

Figure 12:
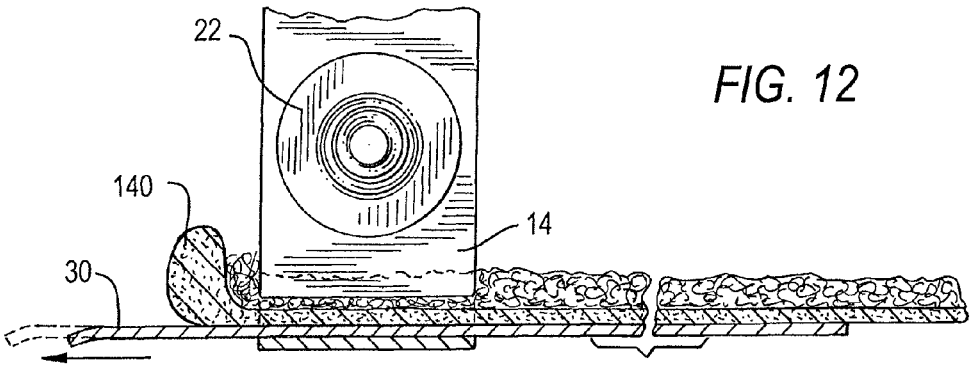
FIG. 12 is a sectional view taken on line 12-12 of FIG. 10.

Turning now to the food handling device 10 of FIGS. 10-12, a portable holder is configured from an elongated, adjustable strip having opposite end regions 12, 14 that are brought together to form an annular body portion 16 bounding an interior. The strip is advantageously made of a resilient material, such as plastic, but could also be made of other materials. A first pair of fasteners 18 are fastened together, and a second pair of fasteners 22 are fastened together, each fastener being preferably of the snap type, with enough excess material from the strip, to form an annular central portion 20. The above-described foodstuff 140 is supported on a movable member 30, and they are jointly mounted within the interior of the annular body portion 16. The opposite end regions 12, 14 extend at least partly diametrically across the annular body portion 16 into engagement with the foodstuff 140 and serve as a resilient holding portion for fixedly holding the foodstuff 140 against movement. A plurality of eating accessories, such as utensils, e.g., a knife, fork, spoon, or pair of chopsticks, as well as napkins or straws, are mounted and held within the annular central portion 20. In addition, one or more such eating accessories could be mounted in a V-shaped recess located at the top of the annular body portion 16.

In use, as shown in FIG. 12, the pizza slice 140 is placed on the movable member 30, advantageously configured as a plate, e.g., a paper plate, and the plate with the pizza slice 140 thereon are bent into a curved shape to conform to the inner circumferential surface of the annular body portion 16 and jointly placed underneath the resilient holding portion 12, 14, which advantageously is first pushed up to make clearance for the curved plate with the pizza slice 140 thereon, and then released to return by spring action from the central portion 20 to the illustrated position. As noted above, the resilient holding portion 12, 14 engages the pizza slice 140 and holds the same stationary. Then, the user 118 holds the device 10 with one hand, and grips a rear portion of the movable member 30 with the other hand, and progressively pulls the movable member 30 along a longitudinal direction relative to the pizza slice 140 away from the user with the other hand, thereby enabling the user to incrementally expose the pointed front end of the pizza slice 140 in order to eat the pizza slice 140 bite-by-bite in a sanitary manner, that is without spilling any toppings, without soiling one's hand, and without requiring the use of any traditional eating utensils. A plurality of food handling devices 10 may be arranged on the platter 114 in analogous manner to that described above for food handling devices 120, 220.

Figure 13:
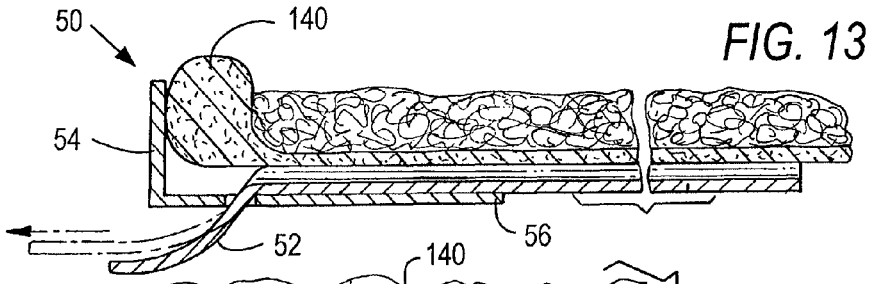
FIG. 13 is a broken-away, side view of another embodiment of a food handling device in accordance with this disclosure.
Figure 14:
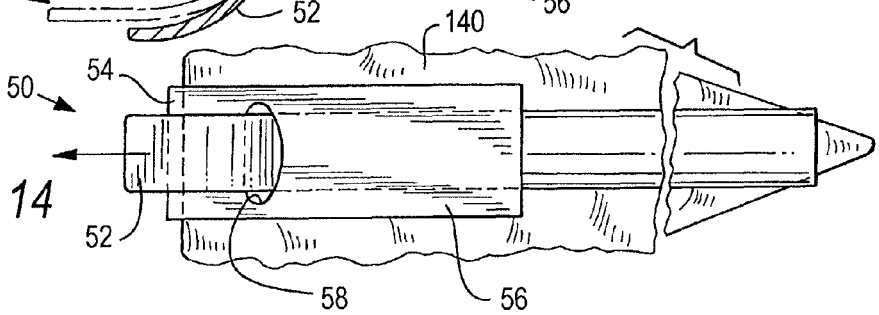
FIG. 14 is a broken-away, bottom plan view of the device of FIG. 13.

Turning now to the food handling device 50 of FIGS. 13-14, a portable holder includes a base portion 56 on which a movable member 52 and the above-described foodstuff 140 are supported, a raised projection 54 for holding the foodstuff 140, and a slot 58 through which the movable member 52 passes. Preferably, the movable member 42 is curved in an arch to add strength to support the pizza slice 140. In use, as shown in FIG. 13, the user 118 holds the holder with one hand, grips a rear portion of the movable member 52 with the other hand, and progressively pulls the movable member 52 through the slot 58 along a longitudinal direction relative to the pizza slice 140 away from the user with the other hand, thereby enabling the user to incrementally expose the pointed front end of the pizza slice 140 in steps in order to eat the pizza slice 140 bite-by-bite in a sanitary manner, that is without spilling any toppings, without soiling one's hand, and without requiring the use of any traditional eating utensils. The raised projection 54 serves as a stop flange against which the rear end of the pizza slice 140 abuts, and holds the pizza slice 140 in a fixed position during movement of the movable member 52. In a variation, the raised projection 54 can be a pointed barb or tooth which pierces the pizza slice 140 to fix the latter in a stationary position. A plurality of food handling devices 50 may be arranged on the platter 114 in analogous manner to that described above for food handling devices 120, 220, 10.

Figure 15:
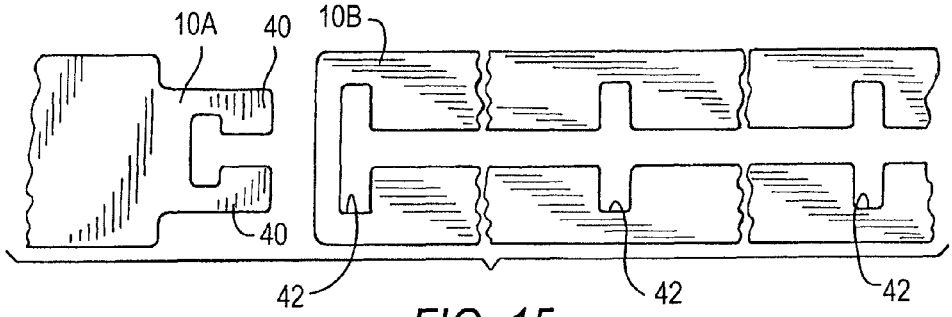
FIG. 15 is a broken-away, side view of a detail of the food handling device of FIG. 10.

FIG. 15 depicts one method of adjusting the perimeter of the annular body portion 16 of the device 10. Thus, one end portion 10A of the strip has a projecting portion with a pair of resilient prongs 40, and the other end portion 10B of the strip has a plurality of recesses 42 arranged successively apart lengthwise of the strip. The resilient prongs 40 engage with a snap type action into any selected one of the recesses 42 to adjust the perimeter of the annular body portion 16 of the strip to accommodate different sizes and shapes of the foodstuff and the movable member placed therein.

Thus, for the food handling devices 10, 50, the pizza slice 140 is held stationary, while each moving member 30, 52 is moved relative to the pizza slice 140 away from the user. By contrast, for the food handling devices 120, 220, the movable members 130, 240 are jointly movable with their respective pizza slices 140 towards the user.

As described so far, the lower end of the support 112 of the food service assembly is adapted to be supported on top of a generally horizontal support surface, such as a table top or countertop, with the aid of the base 116. Other mounting configurations are also contemplated. For example, FIG. 16 depicts a spring-biased clip or clamp 150 having opposing jaws 152 that grip upper and lower surfaces of a generally horizontal support surface 154. The jaws 152 could also be concave to grip opposite sides of a different support surface, such as around post or pole. The lower end of the support 112 is connected to the clamp 150 via an adapter 156 in which a resilient cushion 158 is received. The cushion 158 compresses under the weight of the food service assembly and self-adjusts as needed in order to compensate for any tilting of the support 112 created by any variation in the size of the support surface 154 and any variation in the opening of the clamp 150. The adapter 156 need not be mechanically fixed to the clamp 150 as shown, but could be magnetically attached thereto, and could also be mounted for turning movement about a vertical axis thereon.

As another example, the lower end of the support 112 can be mounted on a round post or pole staked into the ground or sand as on a beach, or in the snow. FIG. 17 depicts a ski pole 160 on which a food service assembly comprised of the platter 114 and the support 112 are detachably mounted with the aid of a tubular clamp 162.

As another example, as shown in FIG. 18, the lower end of the support 112 can be configured with a first enlarged frustoconically-shaped adapter portion 60 that, in turn, is located above a second enlarged frustoconically-shaped adapter portion 62. The adapter portions 60, 62 need not be frustoconically-shaped, and the support 112 can comprise only one of these adapter portions, or additional adapter portions. Each adapter portion 60, 62 is configured to be received in a correspondingly sized compartment in a cupholder that may be provided in a vehicle, such as a car, boat, or plane, typically in a console or dashboard area adjacent a seat, or in an armchair or seat, such as those located in theaters, arenas, stadiums, outdoor seating areas, etc. Thus, the support 112 of FIG. 18 enables the food service assembly 110 of FIG. 1 to be conveniently supported and stably held anyplace where a cupholder exists. No additional adapter is required, because at least one of the adapter portions 60, 62 will fit into the correspondingly sized compartment of the cupholder. This feature is of especial benefit when the user is being served at a drive-through station of a fast food store.

As also shown in FIG. 18, the support 112 may have an adjustable length. For example, the support 122 may comprise a pair of telescoping sections 112A, 112B whose overall length is adjustable by sliding one of the sections relative to the other of the sections. This adjustability may be used to position a food handling device at about the same elevation as a user's mouth. For example, a patient at a hospital or rehabilitation center, an invalid, or an incapacitated or handicapped person may be unable to use one of his or her hands to hold the food handling device, in which case, the food handling device may conveniently be placed on the platter 114 and remain thereon so that the platter 114 holds the food handling device. Then, the length of the support 112 and, hence, the elevation of the platter 114 relative to a support surface, e.g., the floor, a table, etc., can be varied to position the food handling device at about the same elevation as the user's mouth. The upper end 66 of the upper section 112B may be connected to the platter 114 by various types of connections, both detachable and permanent. For example, the platter 114 may be detachably mounted on the support 112 with a threaded fit, a non-threaded fit, a friction fit, an interference fit, a snap action fit, or a clearance fit.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. For example, the food service assemblies and food handling devices described herein can also be used by campers, or military personnel, or participants in any outdoor or indoor activities, such as picnics, block parties, beach activities, hiking, or sports activities, especially those where it is difficult to keep one's hands clean.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises . . . a," "has . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to, as understood by one of ordinary skill in the art. The term "coupled" is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

I claim:

1. A food handling device for use in eating a foodstuff, comprising:

an elongated holder extending lengthwise along a longitudinal axis and terminating in an open end region, the holder having a slot extending lengthwise along the longitudinal axis toward the open end region of the holder; and a movable member having a support portion for supporting the foodstuff, and an end portion that extends through the slot, the support portion being mounted for movement within the holder and extending lengthwise along the longitudinal axis and terminating in an open leading end past which the supported foodstuff extends during eating, the end portion being slidable along the slot during the movement of the support portion and the supported foodstuff.

2. The device of claim 1, wherein the end portion extends radially of the longitudinal axis through the slot in an upright condition.

3. The device of claim 1, wherein the movable member has another end portion that extends through the open end region of the holder and is manually accessible exteriorly of the holder.

4. The device of claim 3, wherein the other end portion of the movable member has a concave leading edge.

5. The device of claim 3, wherein the open end region of the holder has a beveled leading edge.

6. The device of claim 1, wherein the other end portion of the holder is constituted of a bendable material.

7. The device of claim 1; and further comprising a sensor mounted on the holder for detecting a distance though which the movable member and the supported foodstuff have moved, and a stop mounted on the holder in the path of movement of the movable member for engaging the movable member and for stopping the movable member and the supported foodstuff when the movable member and the supported foodstuff have reached a predetermined distance.

8. The device of claim 1, wherein the holder has elongated channels within its interior, and raised projections at its exterior.

9. The device of claim 8, wherein the channels collect drippings from the foodstuff, and wherein the raised projections are elongated ribs.

10. The device of claim 1, wherein the holder is configured and sized to be portable and to be held in a user's hand adjacent the user's mouth during eating of the foodstuff.

11. The device of claim 1, wherein the holder is tubular and is constituted of a resilient material.

12. The device of claim 1, wherein the movable member is moved incrementally along the longitudinal axis to enable the supported foodstuff to be eaten bite-by-bite while remaining supported on the support portion of the movable member.

13. A portable food service assembly, comprising:

an upright support;

a platter mounted on the support; and a plurality of food handling devices for use in eating foodstuffs, each device being mounted on the platter, each device including an elongated holder extending lengthwise along a longitudinal axis and terminating in an open end region, the holder having a slot extending lengthwise along the longitudinal axis toward the open end region of the holder, and a movable member having a support portion for supporting the foodstuff, and an end portion that extends through the slot, the support portion being mounted for movement within the holder and extending lengthwise along the longitudinal axis and terminating in an open leading end past which the supported foodstuff extends during eating, the end portion being slidable along the slot during the movement of the support portion and the supported foodstuff.

14. The assembly of claim 13, wherein the support is elongated and has an adjustable length.

15. The assembly of claim 13, wherein the platter is detachably mounted on an upper portion of the support.

16. The assembly of claim 13, wherein the support has a base for supporting the assembly on a support surface.

17. The assembly of claim 13, and a clamp attached to the support for clamping the assembly on a support surface.

18. The assembly of claim 13, and a stake on the support for staking the assembly into a support surface.

19. The assembly of claim 13, and an adapter portion on the support for mounting the assembly in a cupholder compartment.

20. The assembly of claim 13, wherein the devices are removably mounted on the platter.

* * * * *